United States Patent [19]

Watanabe et al.

[11] 4,407,056

[45] Oct. 4, 1983

[54] METHOD AND APPARATUS FOR MANUFACTURING METAL SECTIONS

[75] Inventors: Kazuo Watanabe; Hideki Tokita, both of Kitakyushu; Koe Nakajima, Nakama, all of Japan

[73] Assignee: Nippon Steel Corporation, Tokyo, Japan

[21] Appl. No.: 335,669

[22] Filed: Dec. 30, 1981

Related U.S. Application Data

[63] Continuation of Ser. No. 81,814, Oct. 4, 1979, abandoned.

[30] Foreign Application Priority Data

Apr. 7, 1978 [JP] Japan ..... 53-40280

[51] Int. Cl.[3] ..... B21B 15/00

[52] U.S. Cl. ..... 29/527.7; 72/190; 72/206; 72/402; 72/403

[58] Field of Search ..... 29/155 R, 526.2, 526.3, 29/527.5, 527.7; 72/187, 189, 190, 194, 206, 394, 399, 401, 402, 403, 406, 407

[56] References Cited

U.S. PATENT DOCUMENTS

| | | | |
|---|---|---|---|
| 1,108,862 | 8/1914 | Crawford | 72/206 |
| 3,147,521 | 9/1964 | Boehm | 29/526.3 |
| 3,340,716 | 9/1967 | Funk | 29/527.7 |
| 3,445,922 | 5/1969 | Leghorn | 29/527.7 |
| 3,533,260 | 10/1970 | Marcovitch | 72/190 |
| 3,626,746 | 12/1971 | Pietryka | 72/402 |
| 3,737,981 | 6/1973 | Plockinger et al. | 29/527.7 |
| 3,837,210 | 9/1974 | Kralowetz | 72/403 |

FOREIGN PATENT DOCUMENTS

| | | | |
|---|---|---|---|
| 2004532 | 8/1971 | Fed. Rep. of Germany | 72/399 |
| 2531591 | 2/1977 | Fed. Rep. of Germany | 72/206 |
| 437816 | 7/1948 | Italy | 72/399 |

*Primary Examiner*—Lowell A. Larson

*Attorney, Agent, or Firm*—Wenderoth, Lind & Ponack

[57] ABSTRACT

In making metal sections, starting material having a quadrangular cross-section is hot-forged into a blank resembling the desired product in cross-section, and the length of the piece is divided into sections of a given length. Then, the blank is hot-rolled into the product having the desired cross-section.

12 Claims, 19 Drawing Figures

METHOD AND APPARATUS FOR MANUFACTURING METAL SECTIONS

This is a continuation application of application Ser. No. 81,814, filed Oct. 4, 1979 now abandoned.

BACKGROUND OF THE INVENTION

This invention relates to a method and apparatus for manufacturing metal sections, and more particularly to a method and apparatus for forming starting material with a quadrangular cross-section into a metal section with the desired cross-sectional shape.

Conventionally, blanks or semi-finished materials for the rolling of sections have been manufactured mostly by the primary-mill process, with some being manufactured by the continuous-casting process.

Outdone in efficiency, yield, energy consumption and some other respects, all the same, the primary-mill process is being increasingly supplanted, especially in Japan, by the continuous-casting process that casts molten metal continuously into blanks (or semi-finished sections).

But continuous casting itself is not without problems. The need of changing molds for different shapes and sizes lowers equipment utilization and production rates. Continuously cast intricate sections are subject to such quality problems as cracking and segregation during cooling. To insure high-quality, high-efficiency continuous casting, the cross-sectional shape of the casting must be as close as possible to a flat rectangular shape. Another important requisite is that the size of the casting vary as little as possible, or the quantity of each size lot be as large as possible. Such quadrangular casting is then formed into blanks of various shapes and sizes by a subsequent process.

Primary mills for rolling quadrangular materials into blanks, especially those comprising paired horizontal rolls with shape passes, require that the starting material have a large enough cross-sectional area to secure the desired flange width. This unavoidably entails an increase in threading frequency and a drop in productivity.

Use of universal mills for the rolling of quadrangular materials into blanks has also been proposed, with a promise of much lower threading frequency than with the grooved rolls. In rolling, on whatever type of mill, however, metal flow in the rolling direction is inevitable, which is made up for by the supply from the flange portion. The result is a metal shortage in the flange portion and a failure to secure the desired flange width. Universal mills are no exception.

SUMMARY OF THE INVENTION

This invention has been made with a view to solving the aforementioned conventional problems in the manufacture of metal sections.

An object of this invention is to provide a method and apparatus for manufacturing metal sections that permits highly intensive operation using starting materials of limited shapes and sizes.

Another object of this invention is to provide a method and apparatus for manufacturing metal sections with a high yield and with great ease.

In order to achieve the aforesaid objects, a method of manufacturing metal sections according to this invention characteristically comprises hot-forging starting material, having a quadrangular cross-section, into a blank resembling the desired product in cross-section, dividing the length of the piece into sections of a given length, then hot-rolling the blank into the product having the desired cross-section.

Apparatus for manufacturing metal sections according to this invention comprises a hydraulic press for hot-forging quadrangular starting material into a blank resembling the desired product in cross-section and a rolling mill for hot-rolling the blank into the desired product.

The method of this invention carries out plastic deformation by combining forging which is likely to cause metal to flow from the lengthwise direction of the piece in the widthwise direction and rolling which is likely to cause metal to flow from the widthwise direction to lengthwise. This combination permits changing the cross-sectional shape of starting material to a great extent. Namely, starting materials of limited shapes and sizes can be made into sections of more varied shapes and sizes.

DETAILED DESCRIPTION OF THE PREFERRED EMBODIMENTS

Forging is a method highly suited for obtaining a desired cross-sectional shape, because metal in the piece being forged, as is generally known, is more likely to flow widthwise than lengthwise.

In carrying out plastic deformation by intermittent application of force, all the same, forging is inferior to rolling in productivity and efficiency because rolling applies continuous force.

However, the practical absence of longitudinal metal flow and great freedom of cross-sectional change, the advantages offered by forging, can be utilized effectively where the comparatively lower productivity and efficiency are not essential such as after a continous-casting line through which the piece travels at a very low speed (0.5–3 m/min) or before the entry section of a rolling mill train where the piece can be passed at a much lower speed than in the later sections, without destroying the mass flow balance.

Now prefered embodiments of this invention will be described in detail.

Figure 1:
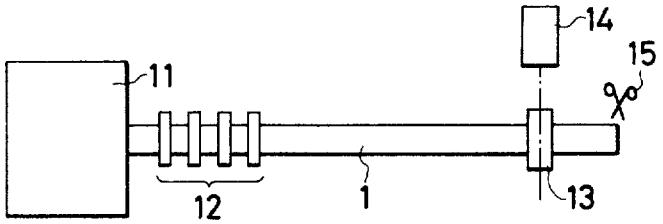
FIG. 1 is a schematic illustration of a conventional process following continuous casting.

FIG. 1 schematically shows a conventional process following continuous casting. A piece 1 leaving a continuous caster 11 is guided by pinch rollers 12 to a rolling mill 13, driven by a motor 14, where some work is carried out on the piece 1, and the piece is then cut to a predetermined length by a shear 15. There are some occasions on which the rolling mill 13 is not used. The generally very low travel speed of the continuous cast piece results in a prolonged contact between the rolling mill rolls and the piece, thereby lowering roll durability. Lack of the possibility of emerging out reversed rolling makes necessary a large number of stands where great elongation or shape change is needed. All this makes this process uneconomical. Further, the aforementioned concentrated operation with blanks of limited sizes and shapes is hardly possible.

Figure 2:
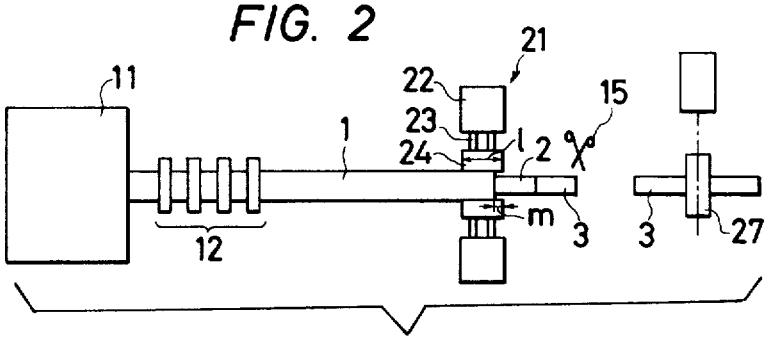
FIG. 2 schematically exemplifies apparatus according to this invention.

FIG. 2 shows a preferred embodiment of this invention. A forging machine 21 is provided behind or downstream of a continuous-casting line. A quadrangular continuous-cast piece 1 is forged thereon, then cut to length by a shear 15.

The forging machine 21 comprises a pair of hydraulic presses 22 disposed on both sides of the casting 1. A forging tool 24 is attached to the end of a ram 23 extending from each hydraulic press 22. The forging machine 21 is placed behind the mold (not shown) of a continuous caster 11 and within a distance from the mold in which the temperature of the casting 1 remains high enough to permit forging (e.g., between 800° and 900° C. for steel). The forging machine is not limited to the hydraulic press type just described. It need be no special type; any common forging machine will do. However provision made is to cause the forging tool to travel some distance along with the piece being forged, because of the need to apply forging pressure on the continuously running piece. The maximum casting speed of today's continuous casters is approximately 2.4 m/min. Therefore, the casting advances at a speed of 40 mm/sec. maximum. Forging time is 1 to 2 seconds. Accordingly, the forging press must move with the casting a distance of approximately 100 mm maximum. This synchronized movement is readily achieved by making the hydraulic press movable with respect to the base and connecting a drive unit, containing a hydraulic cylinder or electric motor that is driven synchronously with the travel of the casting, to the hydraulic press. In addition, it is desirable that the forging machine is be as compact as possible, in view of the large number of strands involved in continuous casting.

The casting is formed under pressure intermittently applied from both sides to a section of its length which corresponds to the length l of the forging tool 24. A tail-end portion of a section 2 just pressed is re-pressed when pressure is applied to the next section, the forging tool 24 overlapping the tail-end portion by a length m. In conjunction with the employment of ideally shaped tools described later, this prevents the creation of a level difference at the border between the two successively pressed sections. The result is a smooth-surfaced blank 3.

The blank 3 thus formed is cut to the desired length by a shear 15, then rolled into the desired cross section on a rolling mill 27.

Figure 3:
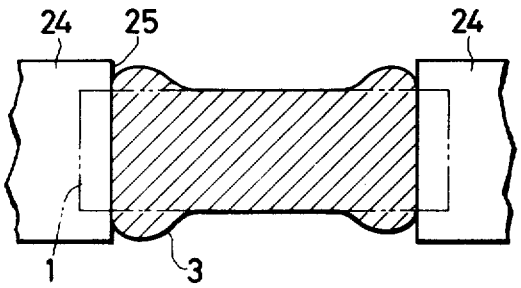
FIGS. 3 and 4 show how a blank is forged according to the method of this invention, using a horizontal forging machine in FIG. 3 and a vertical for-going machine in FIG. 4.

The casting machine 21 shown in FIG. 2 forges the quadrangular casting 1 into the limb-bone like blank 3 as shown in FIG. 3, each side of the casting 1 being pressed by a flat tool surface 25. Provision is made to freely change the width of the blank 3 in accordance with the draft of the forging machine 21. In the subsequent rolling process, the limb-bone-shaped blank 3 is rolled into an H-section. When this blank as forged is charged directly into a heating furnace in the rolling mill plant, its limb-bone like shape produces a secondary effect of limiting the contact with the furnace skids, thereby decreasing the development of skid marks.

As seen, provision of a forging machine permits handling many types of slabs economically. Carrying out of forging before shearing eliminates cross-sectional irregularities and yield drop. Since the travel speed of the casting is very low, technical difficulties which might be experienced in pressing stationary forging tools against the moving piece can be overcome by such contrivances as the provision for the tools to have some freedom to move along with the advancing piece, as described previously.

Figure 4:
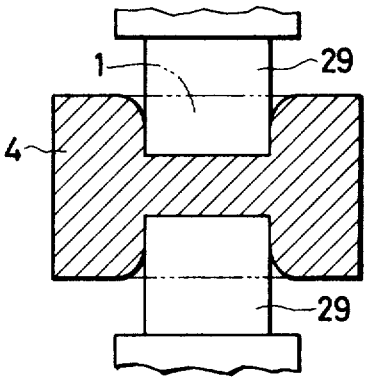

FIG. 4 shows a vertical forging machine which applies pressure to the middle portion of the piece. Forging tools 29 deform the casting 1 into a blank 4. The ultimate shape obtained by this vertical forging is not altogether identical with that of the conventional blanks. But this preliminary forming facilitates forming in the subsequent stages and helps improve production yield.

When the method of this invention is used with continuous casting, it is desirable to forge and roll the continuous-cast starting material in close succession for the effective utilization of the starting material's sensible heat. But it is also permissible, where plant layout or other limitations exist, to stock the casting or forged blanks for postponed forging or rolling after reheating.

Figure 5:
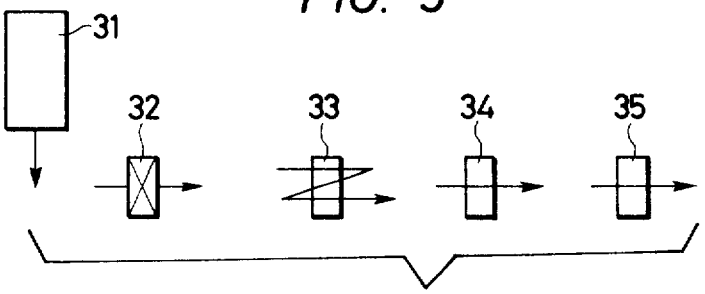
FIG. 5 shows a layout for implementing this invention not on the continuous-casting line but in the finished product rolling plant.

FIG. 5 shows an example of the latter case, in which forging is performed not immediately after the continuous-casting line, but, after being sheared, in the finished product rolling mill plant. A rectangular material leaving a heating furnace 31 is formed by a forging machine 32, then rolled on rolling mills 33, 34 and 35. This permits the concentrated operation with limited materials on the same principle as shown in FIG. 2. This embodiment is inferior to the embodiment of FIG. 2 in yield, but superior in simplicity of equipment layout. Besides, this process is applied in the roughing stage where the material has a large enough cross-section to keep the temperature drop within an acceptable limit over a relatively long period of time.

Figure 6:
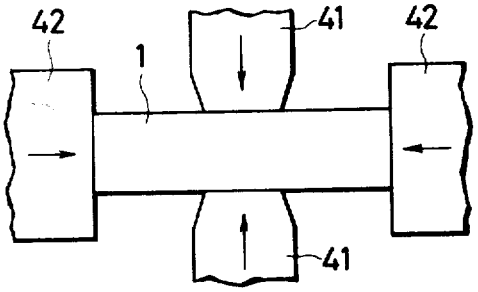
FIGS. 6 (*a*) and (*b*) show a process in which a slab is formed into a blank under vertical and horizontal pressures simultaneously applied; (*a*) before forming, and (*b*) after forming.
Figure 6:
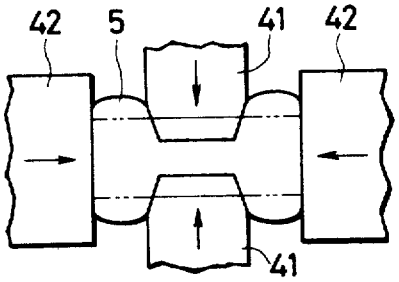

FIGS. 6 (*a*) and (*b*) show a blank forged from a slab under vertical and horizontal pressures applied simultaneously. Vertical tools 41 and horizontal tools 42 are placed in position on a slab 1, and simultaneously actuated to apply pressure until the desired size is obtained. Applying a greater forging load than the method of FIG. 4, this method makes the flange height of a blank 5 much greater than the thickness of the slab 1. This feature makes this method highly effective in the manufacture of blanks with flange height greater than slab thickness.

Figure 7:
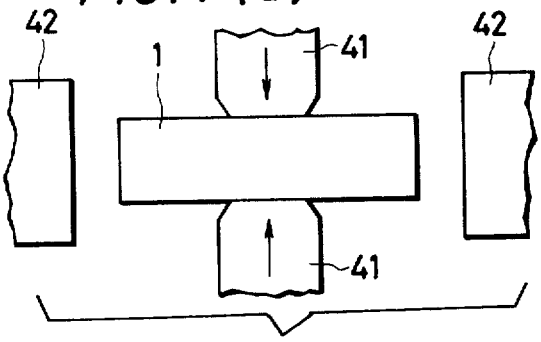
FIGS. 7 (*a*) and (*b*) show a process in which a slab is formed into a blank, first under vertical pressure, then under horizontal pressure; (*a*) before forming, and (*b*) after forming.
Figure 7:
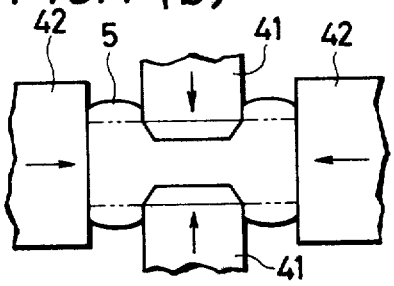

FIG. 7 (*a*) and (*b*) show a blank forged from a slab first under vertical pressure, then under horizontal pressure. First, vertical tools 41 are positioned in the middle of a slab to apply a given amount of vertical pressure. Next, tools 42 apply horizontal pressure to obtain the desired width, with the vertical tools 41 being either held in the pressed position or returned to the original position. This method produces substantially the same effect as the method of FIG. 6, with less forging load.

Figure 8:
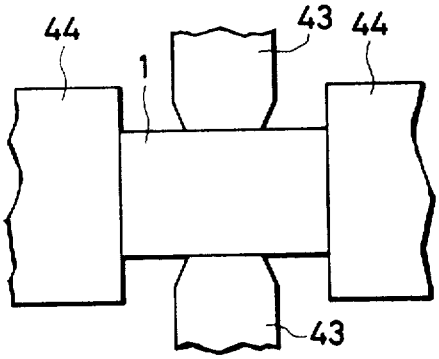
FIGS. 8 (*a*) and (*b*) show a process in which a slab, sized to the width of the desired blank, is formed into a blank under vertical pressure only; (*a*) before forming, and (*b*) after forming.
Figure 8:
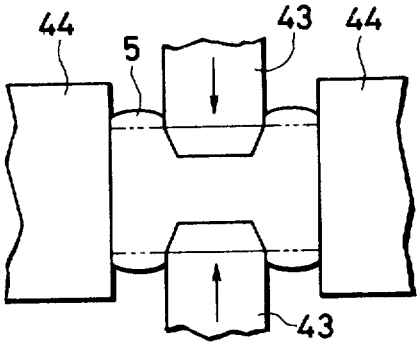

FIGS. 8 (*a*) and (*b*) show the manufacture of a blank using horizontal tools held in a position adjusted to the desired width of the blank and vertical tools applying vertical pressure. Horizontal expansion of a slab under pressure applied by the vertical tools 43 is prevented by the horizontal tools 44. Consequently, the flange width of the blank 5 becomes greater than the thickness of the slab 1, with some longitudinal elongation, as in the cases of FIGS. 6 and 7. The object of this method is to make a well-shaped blank 5 by preventing the expansion with the tools 44. Thus this method is suited for performing forging with relatively small width expansion. Performing no compression, the tools 44 may be, for example, manipulators used for rolling.

Figure 9:
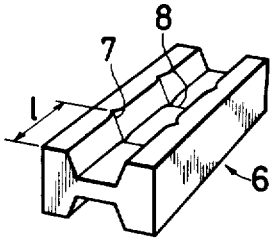
FIG. 9 is a perspective view of a stepped portion developed in a blank formed from a quadruangular material using a forging tool having a uniform cross section throughout its length.
Figure 10:
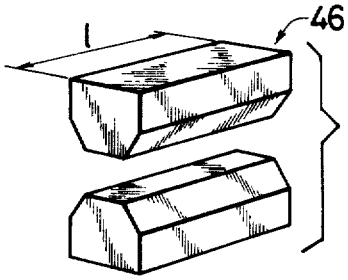
FIG. 10 is a perspective view of a forging tool having a uniform cross section throughout its length.

FIG. 9 shows a blank made by subjecting a bloom to vertical pressure only, using forging tools such as tools 46 having a uniform cross-sectional profile throughout the length thereof as shown in FIG. 10. When performing the step of forging of length l, metal lying on both sides of a border between the forged and unforged portions expands differently because it is restrained differently. This results in the formation of a step 7 on the inside of the flange, as shown in FIG. 9, which causes surface irregularities and considerable longitudinal variation in flange thickness and width. The resulting shape difference between the border portion and regularly shaped portion is undesirable for rolling. The same uniformly shaped tools apply a uniform pressure on all parts of the web, thereby depressing metal in the border area as shown in FIG. 9. This also produces stepped surface irregularities 8 which are undesirable for rolling.

Figure 11:
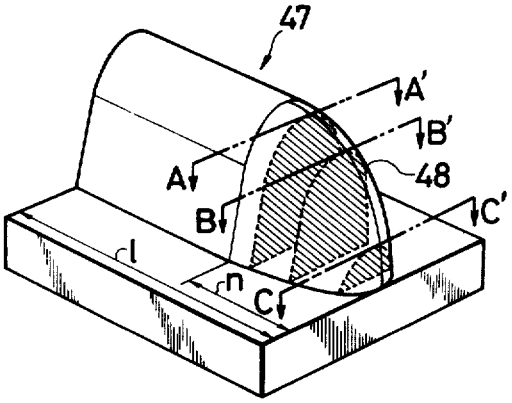
FIG. 11 shows cross-sectional profiles of a tapered portion of a forging tool.

FIG. 11 shows a forging tool according to this invention. The forging tool 47 of FIG. 11 has a tapered portion 48 tapering away from the surface to be pressed, i.e. toward the ram 23 and also toward the longitudinal centerline of the tool, so that increasingly less pressure is applied toward the tip of the tool (within a longitudinal distance n), both vertically and widthwise. This tapered portion 48 produces a gradually deformed smooth border, which receives, in the next step forging, smooth pressure extending from the unforged portion to the forged portion, thus preventing the depression of metal and substantially eliminating the formation of steps at the completion of forging. Dimensions of this tool, for example, may be as follows: full length of the tool = 100 mm, length of the tapered portion = 300 mm, radius of the uniform profile portion 120 mm, and radius of the tapered, spherical portion = 300 mm.

Figure 12A:
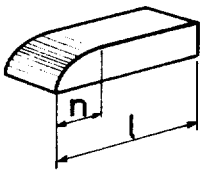
FIGS. 12 (*a*) and (*b*) show forging tools used in the manufacture of a blank according to this invention; (*a*) shows a tool that applies decreasing vertical pressure toward its tip, and (*b*) shows a tool that applies decreasing widthwise pressure toward its tip.
Figure 12B:
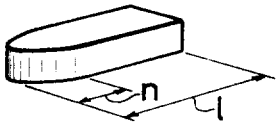

FIGS. 12 (*a*) and (*b*) show other forms of the tapered portion.

FIG. 12 (*a*) shows a forging tool having a tapered portion that tapers only toward the ram 23 and applies decreasing vertical pressure within a longitudinal distance n).

FIG. 12 (*b*) shows a forging tool having a tapered portion that tapers only toward the longitudinal centerline of the tool and applies decreasing widthwise pressure within a longitudinal distance n).

The tapered portion of the forging tool shown in FIG. 11 may be regarded as a combination of the tapered portions in FIGS. 12 (*a*) and (*b*).

When large width expansion, or a blank with large web width, is needed, a flat forgoing tool may be used. This invention, thus, employs forging tools of appropriate shapes for different cross-sectional shapes and dimensions of the desired blanks.

Figure 13:
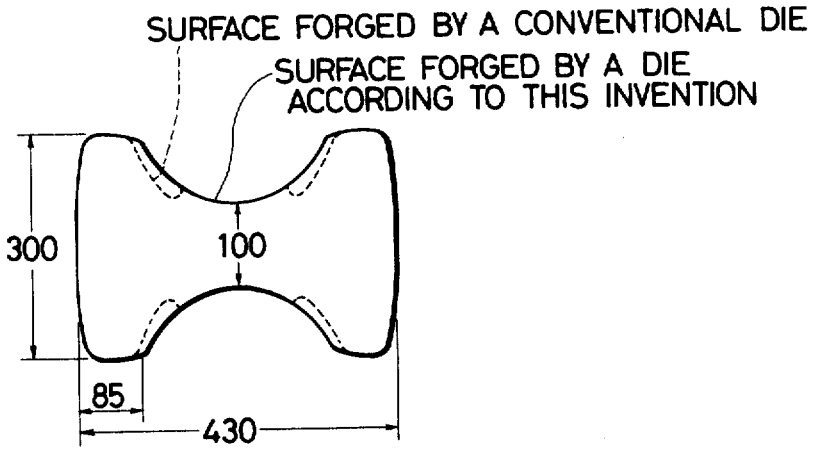
FIG. 13 shows a difference in the cross section of step-forged boundaries formed by a conventional forging tool and one according to this invention.

FIG. 13 shows a cross-section of a border portion of a blank formed by step forging with the forging tools shown in FIG. 11. The material bloom, 300 mm high, 340 mm wide and 7,500 mm long, was given 14 step forgings, with a tool overlap of 400 mm for every border portion. A forging machine having a maximum compressing capacity of 1,500 tons and a forging speed of 50 mm/sec. was used. The material having an average temperature of approximately 1,100° C. was compressed 200 mm under a forging load of approximately 700 tons. Forging was completed in approximately 150 seconds, well matched with the subsequent rolling process. In the figure, the solid line shows the cross section of the blank formed by the aforementioned tools with a tapered portion, and the dotted line the blank formed by conventional uniformly shaped tools. The tapered tools substantially eliminated the forging irregularities at the border portion which were unavoidable with the conventional tools. The tapered tools are suited for forging not requiring much width expansion, since they produce less horizontal expansion than the flat tools. The crop at the head and tail ends of the blank was approximately 100 mm each, proving a marked superiority in yield over the primary mill rolling process.

Figure 14:
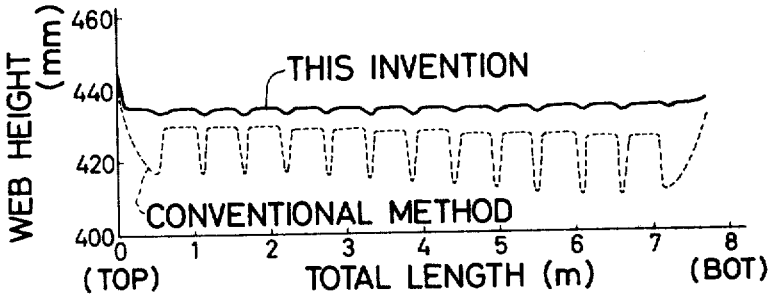
FIGS. 14 (*a*) and (*b*) show surface irregularities in the web and flange of blanks formed according to a conventional method and a method according to this invention.
Figure 14:
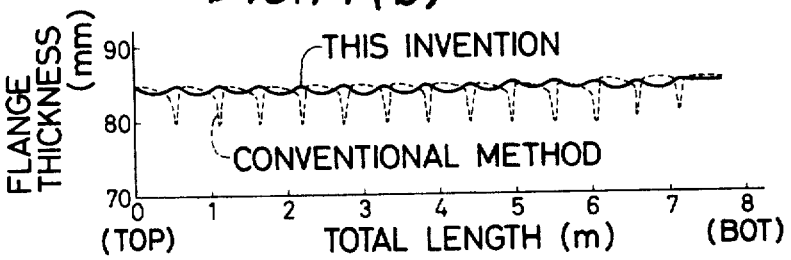

FIGS. 14 (*a*) and (*b*) show the absolute web height and flange thickness measured over the entire length of the above-described blank. In both figures, the solid line indicates the value for the tools according to this invention, and the dotted line the value for the conventional tools having a uniform cross-section throughout the entire length thereof. Irrespective of the type of forging tool, web height at the head and tail ends of the blank is somewhat greater than in the middle, for lack of restraint imposed by the piece itself. A remarkable difference exists in the border portion. The conventional tools produce a web height dfferent of approximately 15 mm between the regular and border portions, developing surface irregularities over the entire length. The tools according to this invention produce a blank with a substantially uniform cross section throughout, decreasing the web height difference to between 2 and 3 mm.

Like web height, flange thickness also shows a marked difference in the border portion. Applying a uniform pressure throughout the entire length, the conventional tools restrain the piece differently at the front and rear ends, which causes varying width expansion in the piece. This results in a step of approximately 10 mm on the inside of the flange corresponding to the border between individual forging steps. Applying different pressures at the front and rear ends, the tools of this invention develop substantially equal width expansion in the regular and border portions of the piece, with a step of approximately 2 to 3 mm only. This results in a well-shaped blank with a substantially uniform flange thickness throughout.

As is evident from the above, step forging with the tools according to this invention produced the desired, satisfactory blank with great shape and dimensional improvements.

Although the above-described embodiments of the method and apparatus for making H-sections, this invention is by no means limited thereto, but is applicable to channels, sheet piles, angles with unequal legs and thickness, bulb angles and other sections. The starting material tool is not limited to casting, but may be selected from the primary mill products rolled from ingots.

As will be understood, this invention is not limited to the particular embodiments described, but covers all modifications falling within the spirit and scope of this invention.

What is claimed is:

1. A method of manufacturing metal sections, comprising:

hot-forging a substantially quadrangular cross-section starting material in the longitudinal direction thereof into a blank having a concave portion therein in the middle of the long sides of the cross-section and upstanding flange portions at the ends of the long sides of the cross-section by applying, while moving the starting material in the direction of the length, forging pressure to the opposite surfaces defining the long sides of the cross-section and along a length of the starting material, which forging pressure is applied substantially perpendicular to the longitudinal axis of the starting material and being uniform from one end of the length to near the other end, and then gradually decreasing to said other end, while at the same time applying further forging pressure to the opposite surfaces of the starting material defining the end surfaces of the cross-section and in a direction substantially perpendicular to the longitudinal axis of the starting material, said further pressure being sufficient for at least preventing material of the starting material from flowing toward the ends of the cross-section of the starting material, repeating the application of forging pressures on the succeeding lengths of the starting material and applying the uniform forging pressure to the portion of the preceeding length to which the gradually decreasing forging pressure has been applied for forming a substantially uniform cross-section throughout the entire length of the blank; and hot rolling the blank into a generally H-shaped metal section having the desired cross-section.

2. A method as claimed in claim 1 in which the forging pressure is applied to all four faces of said blank.

3. A method as claimed in claim 1 further comprising first forming starting material by continuous casting.

4. A method as claimed in claim 1 in which the pressure gradually decreases in a direction toward the starting material.

5. A method as claimed in claim 1 in which the pressure gradually decreases in a direction transverse to the direction toward and away from said starting material.

6. A method as claimed in claim 1 in which the pressure gradually decreases in a direction toward the starting material and in a direction transverse to the direction toward and away from said starting material.

7. An apparatus for manufacturing metal sections comprising:

a forging press for hot forging a substantially quadrangular cross-section starting material into a blank having a substantially H-shaped cross-section resembling that of the desired product, said forging press having means for positioning the starting material and means for moving tools in a direction toward opposite surfaces of the starting material in position in said positioning means and which surfaces define the longer sides of the cross-section of the starting material, said moving means moving said tools substantially perpendicular to the longitudinal axis of the starting material in said positioning means, and elongated forging tools on said moving means extending in the direction of the length of the starting material when it is positioned in said positioning means, said tools each having a pressure applying face with a width less than the width of the opposite surfaces of the starting material which define the longer sides of the cross-section of the starting material and a uniform cross-sectional profile from one end to near the other end and having the portion from near the other end to the other end tapered at least in a direction for gradually reducing the forging pressure applied to the starting material by the forging tool;

said forging press having further means for moving forging tools in a direction toward the opposite surfaces of the starting material in position in said positioning means which surfaces define the end surfaces of the cross-section of the starting material, said further means being capable of applying a pressure which is at least sufficient for preventing material of the starting material from flowing toward the ends of the cross-section of the starting material;

means for moving said starting material and said forging press relative to each other in a direction of elongation of said forging tools and from said tapered portion toward said uniform cross-section portion and through a distance equal to the length of the uniform cross-section profile along said forging tool; and hot rolling means downstream of said forging press for hot rolling the blank into a generally H-shaped metal section having the desired cross-sectional shape.

8. An apparatus as claimed in claim 7 in which said forging tools have said portion tapered in a direction opposite the direction in which said moving means moves the starting material.

9. An apparatus as claimed in claim 7 in which said forging tool has said portion tapered in a direction toward the longitudinal centerline of said tool.

10. An apparatus as claimed in claim 7 in which said forging tool has said portion also tapered in a direction toward the longitudinal centerline of said tool.

11. An apparatus as claimed in claim 7 further comprising a continuous casting means upstream of said apparatus for providing the starting material to said apparatus.

12. An apparatus as claimed in claim 7 in which said means for moving said starting material and said forging press comprises means for conveying said starting material past said forging press, and means for moving said forging press with said starting material for a distance equal to the length of said uniform cross-section profile of said forging tool and then moving said forging press in the opposite direction of movement from the direction of movement of said starting material an equal distance.

* * * * *